United States Patent [19]

Pitt

[11] 4,334,661

[45] Jun. 15, 1982

[54] DRINK CONTAINER MOUNTING GROUND STAKE

[76] Inventor: Samuel G. Pitt, Rte. 1, Box 136 A, Carlsbad, N. Mex. 88220

[21] Appl. No.: 942,466

[22] Filed: Sep. 14, 1978

[51] Int. Cl.[3] ..... A47G 23/02

[52] U.S. Cl. ..... 248/146; 248/156

[58] Field of Search ..... 248/146, 156, 311.1, 248/530, 545, 546

[56] References Cited

U.S. PATENT DOCUMENTS

| | | | |
|---|---|---|---|
| D. 162,959 | 4/1951 | Janes et al. | 248/311.1 X |
| D. 164,692 | 10/1951 | Kelley | 248/311.1 X |
| D. 228,335 | 9/1973 | Jackson | 248/311.1 X |
| 1,468,661 | 9/1923 | Friedman | 248/546 X |
| 1,952,789 | 3/1934 | Butts | 248/156 X |
| 2,322,600 | 6/1943 | Stahler | 248/545 |
| 2,899,153 | 8/1959 | Parker | 248/156 X |
| 3,141,644 | 7/1964 | Baird | 248/DIG. 7 |
| 3,273,841 | 9/1966 | Cota | 248/156 X |
| 3,860,213 | 1/1975 | Heenan | 248/156 X |

*Primary Examiner*—William H. Schultz

*Attorney, Agent, or Firm*—Warren H. Kintzinger; Warren H. Kintzinger

[57] ABSTRACT

A fluid drink container mounting ground stake with a pointed bottom and blunted top having a laterally extended drink container supporting foot and a ring spaced above the foot and in general alignment therewith for holding a drink container spaced above the surface of ground the stake is driven into.

3 Claims, 4 Drawing Figures

DRINK CONTAINER MOUNTING GROUND STAKE

Figure 1:
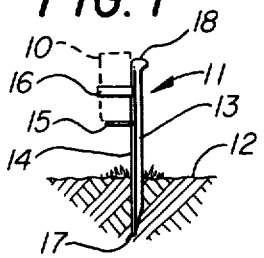

This invention relates in general to drink fluid receptacle supports, and more particularly to a plastic stake support for a drink glass, can, or bottle, with the stake adapted for being inserted or drivin into the ground to support the drink container above the ground.

When one is on a picnic, fishing from a bank, or camping, the support placement of a drink container can be an awkward problem when the container is not being manually held. Further, when a drink container is placed directly on the ground it may be on an unstable surface, the container may become quite dirty and messy to handle, and the container and its contents may be subject to contamination from insect life much more than desired when resting directly on the ground.

It is therefore a principal object of this invention to provide a container support holding a drink container in a stable reliable manner.

Another object is to provide such a container support that helps prevent dirt and insect contamination of a drink container and its contents.

A further object is to provide a drink container support, easy and convenient to use in the outdoors environment.

Features of the invention useful in accomplishing the above objects include, in a drink container mounting ground stake, a tough "T" cross section stake pointed at the lower end to facilitate insertion into the ground. The stake is formed with a laterally extended foot to give vertical support to a drink container placed thereon and ring is integrally formed with the stake sufficiently spaced above the foot to give reliable lateral support to drink containers placed therein and on the foot.

A specific embodiment representing what is presently regarded as the best mode of carrying out the invention is illustrated in the accompanying drawing.

Figure 2:
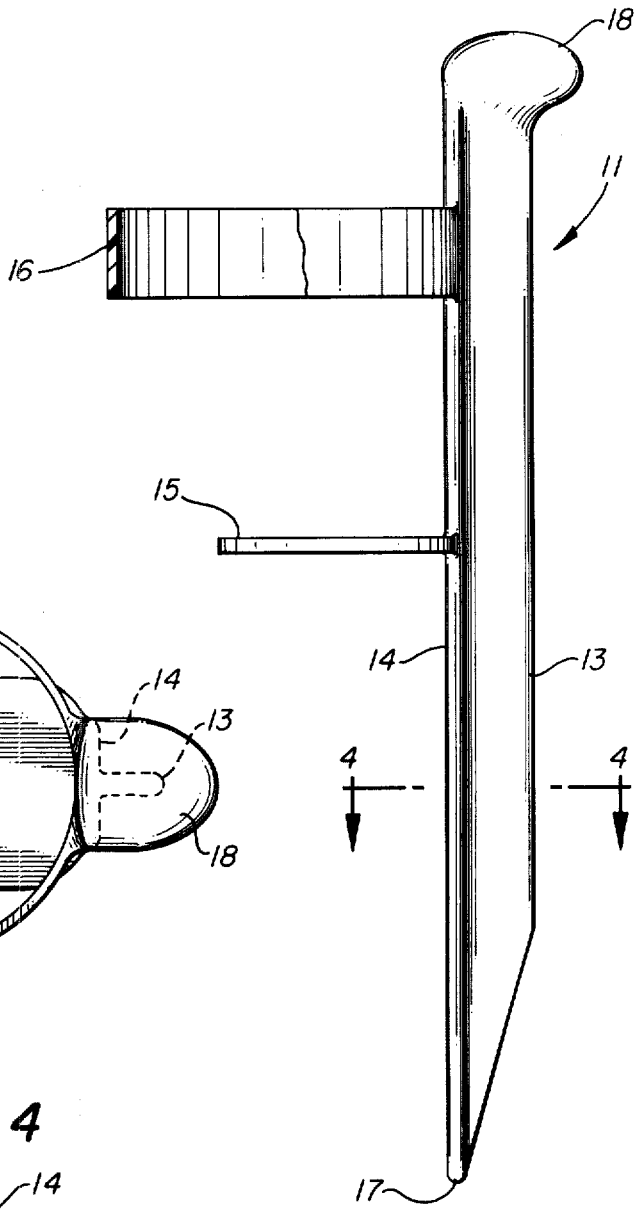
Figure 3:
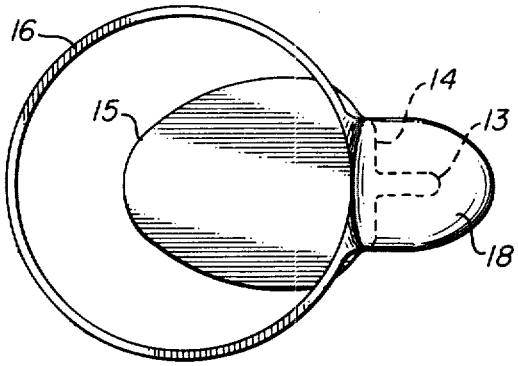
Figure 4:
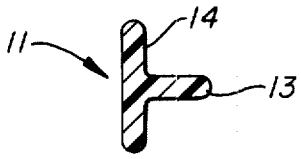

In the drawing;

FIG. 1 represents a side elevation view of a drink container support stake driven into the ground;

FIG. 2 an enlarged side elevation view of the stake of FIG. 1 with its ring partially broken away and sectioned;

FIG. 3 a top plan view of the drink container support stake of FIGS. 1 and 2; and FIG. 4 a transverse section taken along line 4—4 of FIG. 2, showing the "T" section structure of the stake.

Referring to the drawing:

The drink container 10 support stake 11 is shown in FIG. 1 to be driven into the ground 12 to such an extent as to firmly support the stake 11 with any container 10 (drink glass, can or bottle indicated in phantom) held above and spaced from the ground surface. The stake 11 as shown in greater detail in FIGS. 2 and 3 has a stake body 13 of "T" cross section as shown in transverse section in FIG. 4 on line 4—4 of FIG. 2. The "T" cross portion 14 of the stake "T" cross section is shown to have a lateral foot extension 15 that supports a drink container 10 from the bottom, and also a ring 16 generally aligned with and spaced above the foot extension 15 in order to give lateral support to a drink container 10 supported by the stake 11. The stake 11 is made generally of tough high-impact plastic that may be die cast with a pointed bottom end 17 and an enlarged blunted top end 18 that can facilitate driving of the pointed bottom end 17 into the ground 12 and also pulling of the stake 11 from the ground. The foot extension 15 and the ring 16 may be part of an integral plastic casting with the stake body 13 or they may be plastic welded or cemented to the stake body 13. Since the ring 16 in the form of a circumferential band gives lateral support to a drink container, the foot extension 15 need not be of as great lateral expanse as the ring 16.

Thus, there is hereby provided a drink container mounting stake affording stable dependable support for a drink container spaced above the ground surface away from soil contamination. With drink containers supported by the stake there is much less problems with crawling insects and other contamination sources.

Whereas this invention has been described with respect primarily to one embodiment thereof, it should be realized that various changes may be made without departing from the essential contributions to the art made by the teachings hereof.

I claim:

1. A holder for containers in the form of fluid drink containers with the holder in the form of a stake comprising: a stake body having a pointed lower end for being driven into the ground; a laterally extended foot for supporting containers; a ring, integrally a part of the stake, spaced above the foot for lateral support of a container the ring encircles and that is supported by the foot; and wherein said stake body, the laterally extended foot and the ring are a unitary structure of tough cast plastic; and wherein said stake body is formed with a blunted enlarged top in other than vertical alignment with said foot and said ring to facilitate driving of the stake into the ground and removal from the ground and non-interference with an article held by said foot and said ring.

2. The container holder of claim 1, wherein said stake body is generally a "T" section in transverse section; and both said foot and said ring are lateral extensions from the cross of the "T" section of said stake body.

3. The container holder of claim 2, wherein said foot is of less lateral extension than said ring.

* * * * *